US010748156B2

(12) United States Patent
Hunter

(10) Patent No.: US 10,748,156 B2
(45) Date of Patent: Aug. 18, 2020

(54) TARGETING CONTENT BASED ON SENSOR NETWORK DATA WHILE MAINTAINING PRIVACY OF SENSOR NETWORK DATA

(71) Applicant: Google Technology Holdings LLC, Mountain View, CA (US)

(72) Inventor: James M. Hunter, San Jose, CA (US)

(73) Assignee: Google Technology Holdings LLC, Mountain View, CA (US)

( * ) Notice: Subject to any disclaimer, the term of this patent is extended or adjusted under 35 U.S.C. 154(b) by 0 days.

(21) Appl. No.: 16/251,564

(22) Filed: Jan. 18, 2019

(65) Prior Publication Data

US 2019/0156346 A1 May 23, 2019

Related U.S. Application Data

(63) Continuation of application No. 13/324,652, filed on Dec. 13, 2011, now abandoned.

(51) Int. Cl.
*G06Q 30/00* (2012.01)

(52) U.S. Cl.
CPC ..... *G06Q 30/00* (2013.01)

(58) Field of Classification Search
None
See application file for complete search history.

(56) References Cited

U.S. PATENT DOCUMENTS 6,204,763 B1 * 3/2001 Sone ..... A47G 29/141 221/2
7,769,756 B2 8/2010 Krikorian et al.
8,014,762 B2 * 9/2011 Chmaytelli ..... G06Q 30/02 455/414.1
8,250,163 B2 8/2012 Castaldo
8,332,285 B1 * 12/2012 Barua ..... G06Q 10/087 705/28
8,509,954 B2 8/2013 Imes
8,583,579 B1 * 11/2013 Seth ..... G06Q 30/02 706/45

(Continued)

OTHER PUBLICATIONS

International Preliminary Report on Patentability for International Application No. PCT/US2012/066494, dated Jun. 17, 2014, 9 pages.

(Continued)

*Primary Examiner* — Backhean Tiv
(74) *Attorney, Agent, or Firm* — Fish & Richardson P.C.

(57) ABSTRACT

Determination of content for presentation by a client device based on item usage data captured by a sensor network is disclosed. Data describing usage of one or more items at a location is received from a sensor network associated with the location. Content is received from a server and a subset of the received content is selected based on attributes of the data from the sensor network and attributes of the content. The subset of the received content is transmitted to a client device for presentation. In one embodiment, data describing interaction with the subset of the received content is received from the client device and transmitted to a content distribution server for use in selecting additional content. In an embodiment, second content determined by the server using interaction with the subset of the received content and data from the sensor network is received from the server.

24 Claims, 4 Drawing Sheets

(56) References Cited

U.S. PATENT DOCUMENTS 8,725,833 B2 * 5/2014 Hunter ..... G06Q 30/0623 709/217
9,904,925 B2 * 2/2018 Cristofalo ..... G06Q 30/00
2001/0034754 A1 10/2001 Elwahab
2002/0049652 A1 * 4/2002 Moore ..... G06Q 10/0875 705/29
2003/0101454 A1 * 5/2003 Ozer ..... G06Q 30/02 725/42
2004/0024483 A1 * 2/2004 Holcombe ..... G06Q 30/02 700/122
2005/0171634 A1 * 8/2005 York ..... A47K 5/1209 700/231
2006/0253328 A1 * 11/2006 Kohli ..... G06Q 30/0269 705/14.53
2007/0050272 A1 * 3/2007 Godlewski ..... G06Q 20/203 705/28
2007/0088801 A1 * 4/2007 Levkovitz ..... H04L 67/20 709/217
2007/0220907 A1 * 9/2007 Ehlers ..... H02J 3/14 62/126
2007/0244750 A1 * 10/2007 Grannan ..... G06Q 30/0267 705/14.64
2007/0256118 A1 * 11/2007 Nomura ..... H04L 12/2807 726/3
2008/0016081 A1 * 1/2008 MacMillan ..... G06F 16/437
2008/0109317 A1 5/2008 Singh
2008/0147827 A1 * 6/2008 Morris ..... H04L 12/2821 709/220
2008/0157932 A1 * 7/2008 Winkler ..... G06Q 10/06 340/10.6
2008/0255944 A1 * 10/2008 Shah ..... H04L 67/306 705/14.47
2009/0030785 A1 * 1/2009 Goyal ..... G06Q 30/0241 705/14.1
2009/0048905 A1 * 2/2009 Feng ..... G06Q 30/0256 705/14.43
2009/0070436 A1 3/2009 Dawes et al.
2009/0083834 A1 * 3/2009 Rubinstein ..... G06F 21/44 726/2
2009/0119172 A1 * 5/2009 Soloff ..... G06Q 30/0251 705/344
2009/0298480 A1 * 12/2009 Khambete ..... G06F 16/335 455/414.1
2010/0082458 A1 * 4/2010 Godlewski ..... G06Q 10/087 705/28
2010/0088157 A1 * 4/2010 Wilson ..... H04M 3/4872 705/7.12
2010/0117625 A1 * 5/2010 Botts ..... F24C 7/082 324/103 R
2010/0156665 A1 6/2010 Krzyzanowski et al.
2010/0169157 A1 * 7/2010 Muhonen ..... G06Q 30/02 705/7.29
2010/0223641 A1 * 9/2010 Hubbard ..... H04N 7/165 725/35
2010/0262472 A1 * 10/2010 Gautam ..... G06Q 30/0255 705/14.1
2010/0292961 A1 * 11/2010 Moss ..... G01D 4/002 702/188
2011/0191338 A1 * 8/2011 Hylton ..... G06Q 30/0277 707/731
2011/0212711 A1 * 9/2011 Scott ..... G06Q 10/109 455/414.2
2011/0320715 A1 * 12/2011 Ickman ..... G06Q 30/02 711/118
2012/0019378 A1 * 1/2012 Watson ..... H04L 12/2825 340/539.1
2012/0066039 A1 3/2012 Ang
2012/0079538 A1 * 3/2012 Mountain ..... H04N 21/4751 725/45
2012/0296799 A1 * 11/2012 Playfair ..... H02J 3/008 705/37
2013/0005250 A1 1/2013 Kim
2013/0052616 A1 2/2013 Silverstein et al.
2013/0054758 A1 2/2013 Imes
2013/0073366 A1 * 3/2013 Heath ..... G06Q 30/0259 705/14.25
2013/0117106 A1 * 5/2013 Glassman ..... G06Q 30/0223 705/14.53
2013/0124671 A1 * 5/2013 Hunter ..... H04L 67/02 709/217
2013/0151666 A1 * 6/2013 Hunter ..... G06Q 30/00 709/219
2013/0159454 A1 * 6/2013 Hunter ..... H04L 67/325 709/217
2014/0371937 A1 * 12/2014 Weaver ..... G06Q 30/0257 700/291
2019/0156346 A1 * 5/2019 Hunter ..... G06Q 30/00

OTHER PUBLICATIONS

Patent Cooperation Treaty, International Search Report and Written Opinion of the International Searching Authority for International Application No. PCT/US2012/066494 (CS39494), dated Apr. 8, 2013, 12 pages.

* cited by examiner

TARGETING CONTENT BASED ON SENSOR NETWORK DATA WHILE MAINTAINING PRIVACY OF SENSOR NETWORK DATA

CROSS-REFERENCE TO RELATED APPLICATION

This application is a continuation application of U.S. application Ser. No. 13/324,652, filed Dec. 13, 2011, which is incorporated by reference.

FIELD OF THE DISCLOSURE

The present disclosure relates generally to providing targeted content to a user, and more specifically to targeting content to a user based on sensor network data while maintaining the privacy of the sensor network data.

BACKGROUND

Advances in network connectivity and computing capabilities have provided users with greater access to various types of content. For example, users are capable of easily accessing various types of content, significantly increasing the locations where users may retrieve or view content. Additionally, a wider range of content types may be more readily accessed; for example, video data may be viewed from a portable computing device. While this increased access to content has several benefits to users, the increased amount of content may make it difficult for users to identify content of interest from the available content.

Given the divergent interests, needs and habits of users, sorting through the array of content accessible to a user for relevant information may be difficult. While certain methods seek to identify content relevant to a user, these methods capture merely a small aspect of user behavior, such as a user's internet browsing habits, limiting the information available to identify content relevant to a user. Hence, these conventional methods for content identification are limited in their ability to tailor content to a user.

BRIEF DESCRIPTION OF THE DRAWINGS

The accompanying Figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
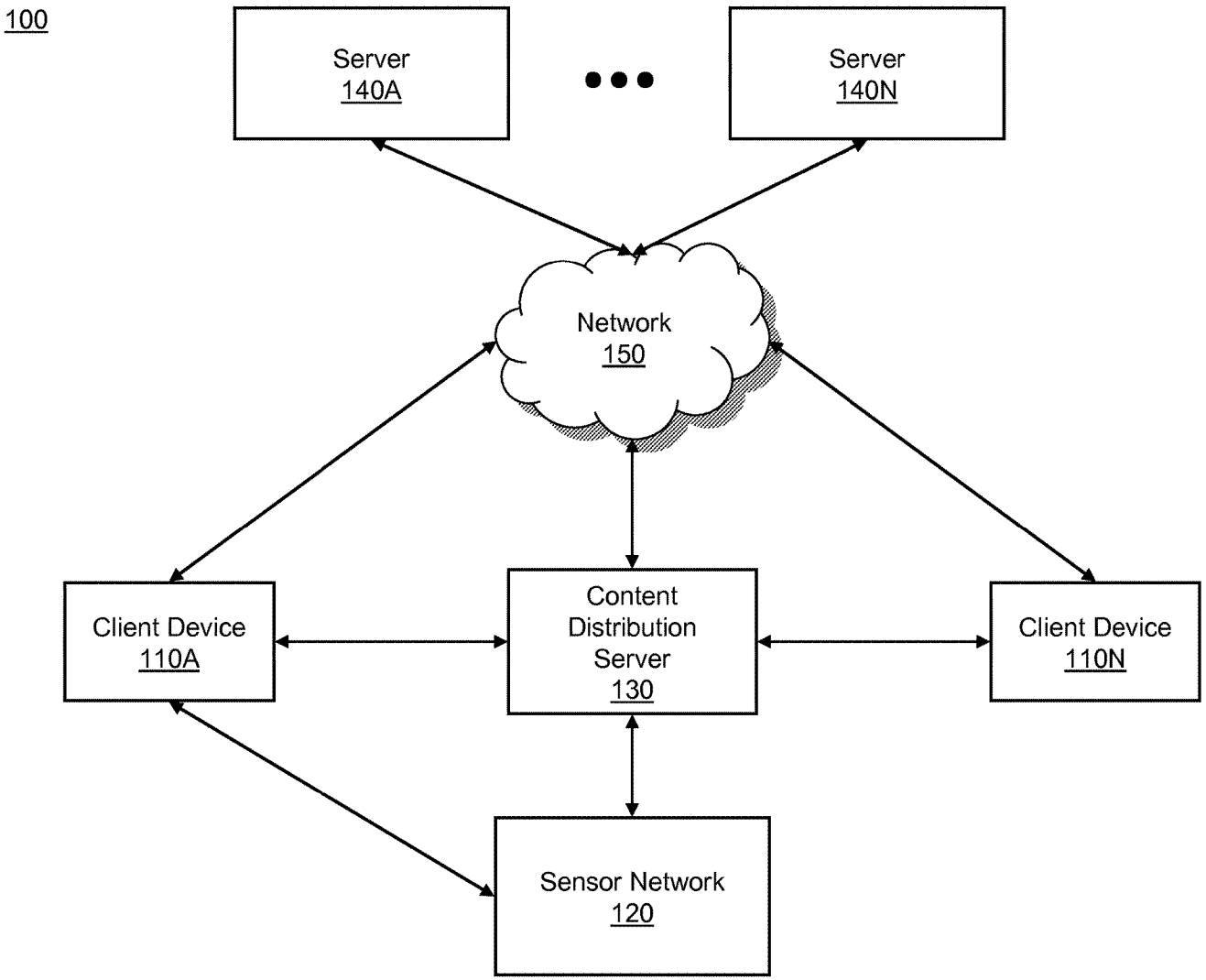
FIG. 1 is a block diagram of a computing architecture in accordance with some embodiments.

Skilled artisans will appreciate that elements in the Figures are illustrated for simplicity and clarity and have not necessarily been drawn to scale. For example, the dimensions of some of the elements in the Figures may be exaggerated relative to other elements to help to improve understanding of embodiments of the present invention.

The apparatus and method components have been represented where appropriate by conventional symbols in the drawings, showing the specific details that are pertinent to understanding the embodiments of the present invention so as not to obscure the disclosure with details that will be readily apparent to those of ordinary skill in the art having the benefit of the description herein.

DETAILED DESCRIPTION

The following disclosure describes a system and method for comparing usage of items at a location associated with a sensor network to attributes of a selected item. Data describing usage of one or more items at a location is received from a sensor network associated with the location. Content is received from a server and a subset of the received content is selected based on attributes of the data from the sensor network and attributes of the content. The subset of the received content is transmitted to a client device for presentation. In one embodiment, data describing interaction with the subset of the received content is received from the client device and transmitted to the server. In an embodiment, second content determined by the server using interaction with the subset of the received content and data from the sensor network is received from the server.

In the following description, for purposes of explanation, numerous specific details are set forth to provide a thorough understanding of the invention. However, it will be apparent to one skilled in the art that the invention can be practiced without these specific details. In other instances, structures and devices are shown in block diagram form in order to avoid obscuring the invention.

System Overview

FIG. 1 is a block diagram of one embodiment of a computing architecture 100. In the embodiment shown by FIG. 1, the computing architecture 100 includes one or more client devices 110A, 110B (also referred to herein individually and collectively using reference number 110), a sensor network 120, a content distribution server 130, one or more servers 140A, 140N (also referred to herein individually and collectively using reference number 140) and a network 150. However, in different embodiments, the computing architecture 100 may include different and/or additional components than those depicted in FIG. 1.

A client device 110 is any device with data processing and data communication capabilities. Examples of a client device 110 include a smartphone, a tablet computer, a netbook computer, a laptop computer or any other suitable device. The client device 110 receives data from one or more servers 140A, 140N via a network 150. In one embodiment, the client device 110 executes one or more applications exchanging data with one or more servers 140A, 140N and/or with the content distribution server 130. For example, the client device 110 executes an electronic mail (e-mail) client application exchanging data associated with one or more e-mail accounts with a server 140. In an additional example, the client device 110 executes a social networking application receiving social network data associated with an account from a server 140 and/or transmitting social network data associated with the account to the server 140. As another example, one or more applications executed by the client device 110 receive one or more of video, audio, image and/or text data from a server 140 and present the received data to a user.

Additionally, a client device 110 is communicatively coupled to one or more of the sensor network 120, the content distribution server 130 and/or one or more servers 140A, 140N. In one embodiment, a client device 110 is directly connected to the sensor network 120 and to the content distribution server 130 and is connected to one or more servers 140A, 140N via a network. Alternatively, a client device 110 is connected to the sensor network 120, to the content distribution server 130 and to one or more servers 140A, 140N using the network 150. However, in various embodiments, a client device 110 uses any suitable connection type or combination of communication types for coupling with other components of the computing architecture 100. In one embodiment, a client device 110 is associated with an account, such as a user account, and includes an account identifier associated with the account. Different client devices 110A, 110B may be associated with different accounts or a single account may be associated with multiple client devices 110A, 110B. In an embodiment, a client device 110 is associated with multiple accounts. For example, a client device 110 includes multiple account identifiers, allowing different users to share a client device 110.

The sensor network 120 comprises one or more sensors associated with a location and capturing data about one or more items at the location. As used herein, an item is a physical entity included at the location. Examples of an item include electronic devices, appliances, consumer items or other physical entities associated with identifying information. The sensor network 120 may include different types of sensors coupled to a computing device and/or a storage device. For example, the sensor network 120 includes a first sensor capturing data describing the frequency with which an item is used, a second sensor capturing power consumption by the item, a third sensor capturing power efficiency of the item, a sensor capturing item health and/or additional sensors capturing or calculating any suitable metric of item usage. In one embodiment, the sensor network 120 includes one or more sensors capturing data identifying item. For example, a sensor in the sensor network 120 captures data associated with the item from a barcode associated with the item, a radio frequency identification tag attached to the item, a near field communication transceiver associated with the item or from any suitable source affixed to, packaged with or included on the item. In one embodiment, one or more sensors in the sensor network 120 capture data describing attributes or properties of location, such as a temperature, a time, an altitude, a humidity or other suitable data.

In one embodiment, sensors in the sensor network 120 may also exchange data with each other. Hence, the sensor network 120 is associated with a location and captures data describing usage of one or more items at the location and/or data describing the location. For example, the sensor network 120 is associated with a home and includes sensors capturing data describing power usage by appliances within the home, a time when an appliance is used, an identifier of an item retrieved from an appliance, a time when the item was retrieved from the appliance, frequency of usage of an appliance or device, frequency with which an item is retrieved from an appliance and/or other data describing usage of items within the location.

In one embodiment, sensors within the sensor network 120 may be associated with a region of the location, allowing the sensor network 120 to include groups of sensors associated with regions of the location. For example, if the sensor network 120 is associated with a home, a first group of sensors is associated with a living room, a second group of sensors is associated with a kitchen and a third group of sensors is associated with a bathroom. This allows the sensor network 120 to capture data describing item usage at different regions within the location or data associated with different regions of the location.

In one embodiment, the sensor network 120 also includes a processor determining additional usage information from data captured by the sensors. For example, the processor calculates a cost of operating an item from the power consumption, calculates a power cost associated with the location including the sensor network 120 and/or estimates a cost of future operation of the item based on frequency of use, power consumption of the item and power cost associated with the location including the sensor network 120. As another example, the processor in the sensor network 120 aggregates item usage or item resource usage from multiple items based on one or more item attributes. For example, the processor aggregates usage data of multiple items based on the region within the location associated the sensor network 120 that includes the items or based on a type associated with an item.

The sensor network 120 is also associated with an account and communicates data captured by the one or more sensors, along with an account identifier and/or a location identifier, to the content distribution server 130. In one embodiment, one or more sensors included in the sensor network 120, or a processor included in the sensor network, include an account identifier in a storage device to specify an account associated with the sensor network 120. A sensor, or a processor included in the sensor network 120, may include a location identifier associated with the location including the sensor network 120. In one embodiment, the sensor network 120 communicates the captured data to the content distribution server 130 via the network 150. This allows the content distribution server 130 to store data describing item usage at the location associated with the sensor network 120 and/or other properties of the location associated with the sensor network 120.

The content distribution server 130 is one or more computing devices having data processing and data communication capabilities. The content distribution server 130 is communicatively coupled to one or more client devices 110A, 110 and the sensor network 120. In various embodiments, the content distribution server 130 uses one or more of a connection to a network 150 and/or one or more direct connections for coupling to a client device 110 and to the sensor network 120. The content distribution server 130 is also coupled to one or more servers 140A, 140N via the network 150.

The content distribution server 130 receives data from the sensor network 120 and/or the client device 110 and associates the received data with an account and/or with a location. Additionally, the content distribution server 130 receives content from one or more servers 140A, 140N and selects a subset of the content for transmission to a client device 110 based on the data received from the sensor network 120. In one embodiment, the content distribution server 130 also uses data received from the client device 110 to select the subset of the content for transmission to the client device 110. For example, the content distribution server 130 compares metadata associated with received content to the data received from the sensor network 120 to select a subset of the content most relevant to items frequently used or accessed at the location associated with the sensor network 120. This allows the content distribution server 130 to increase the relevance of content from a server 140 presented using a client device 110 by identifying a subset of content most relevant to an account or location based on data from the sensor network 120 describing usage of items at the location or attributes of the location itself.

In one embodiment, the content distribution server 130 also schedules transmission of the subset of the content to one or more client devices 110. For example, the content distribution server 130 transmits the subset of the content to a client device 110 based on data from the sensor network 120 describing times when items are used or accessed. The content distribution server 130 may transmit different subsets of content to the client device 110 at different times based on data from the sensor network 120 indicating different usage times of an item or other suitable data. For example, the content distribution server 130 transmits a subset of content associated with restaurants during a time interval determined from stored sensor network data indicating times when a refrigerator is opened or a stove is turned on at the location associated with the sensor network 120. This allows the content distribution server 130 to increase the relevance of the subset of the content transmitted to a client device 110. The content distribution server 130 also transmits the subset of content, or data identifying the subset of content, to the one or more servers 140A, 140N, allowing a server 140 to increase the relevance of content subsequently transmitted to the content distribution server 130 based on attributes of the subset of content.

The content distribution server 130 also receives data from one or more client devices 110A, 110B describing interactions with content using a client device 110. In one embodiment, a client device 110 transmits a content identifier and an interaction identifier to the content distribution server 130 to identify the type of interaction received and the content associated with the interaction. For example, a client device 110 identifies a video viewed by a user of the client device 110 or audio data played by the user of the client device 110. In one embodiment, the content distribution server 130 transmits the data describing interactions with content to one or more servers 140A, 140N, allowing a server 140 to account for prior interactions with content when selecting additional data for transmission to the content distribution server 130.

However, the account associated with the sensor network 120 includes one or more interaction privacy settings, and the content distribution server 130 regulates transmission of data describing interactions with content to servers 140A, 140N based on the interaction privacy settings. For example, an interaction privacy setting may be enabled to prevent transmission of content interaction data to multiple servers 140A, 140N, or an interaction privacy setting may enable transmission of content interaction data to a subset of the servers 140A, 140N while preventing transmission of content interaction data to a second subset of servers 140A, 140N. As additional examples, an interaction privacy setting may allow transmission of data describing a subset of interactions with content and prevent transmission of data describing a second subset of interactions with content. Thus, one or more interaction privacy settings allow a user associated with the account to customize the amount of data describing interactions with content transmitted to a server 140.

Servers 140A, 140N are computing devices having data processing and data communication capabilities that exchange data and/or content with the content distribution server 130 via the network 150. In one embodiment, one or more of the servers 140A, 140N are also coupled to a client device 110 via the network 150. For example, a server 140 transmits data such as a web page, audio content, video content, e-mail, calendar information, social networking data or other content via the network 150 to the content distribution server 130. In one embodiment, a server 140 transmits one or more advertisements or product descriptions to the content distribution server 130.

A server 140 may associate metadata with transmitted content. Examples of metadata include a title, a keyword, a manufacturer identifier or any other information describing an attribute of the content. In one embodiment, the server 140 compares metadata associated with content to stored, or received, data to identify the content transmitted to the content distribution server 130. For example, the server 140 transmits content associated with keywords matching, or similar to, data received from the content distribution server 130. This allows the server 140 to identify content more relevant to content previously transmitted to a client device 110 by the content distribution server 130.

The network 150 is a conventional type for data, video and/or audio transmission. In various embodiments, the network 150 is a wired network, a wireless network or a combination of wireless and wired networks. The network 150 may comprise a local area network (LAN), a wide area network (WAN) (e.g., the Internet), and/or any other interconnected data path across which multiple devices may communicate. The network 150 may be implemented in a variety of configurations, such as satellite link, wireless broadcast links and/or any other suitable configuration. A network 150 may have any number of configurations, such as a star configuration, a token ring configuration or another configuration known in the art. In yet another embodiment, the network 150 may be a peer-to-peer network.

The network 150 may also be coupled to or include portions of a telecommunications network for sending data in a variety of different communication protocols, such as those used for transmission control protocol/Internet protocol (TCP/IP), satellite link and/or cable television communication. For example, the network 150 may transmit voice data using one or more of a Global System for Mobile (GSM) communication system, Code Division Multiple Access (CDMA) system, Universal Mobile Telecommunications System (UMTS) or any other suitable protocols. The network 150 may also transmit data using one or more of General Packet Radio Service (GPRS), second-generation (2G), or greater, mobile network, third-generation (3G), or greater, mobile network, fourth-generation (4G), or greater, mobile network, High Speed Download Packet Access (HSDPA), High Speed Uplink Packet Access (HSUPA), Long-Term Evolution (LTE), Worldwide Interoperability for Microwave Access (WiMax) or any other suitable protocol. In yet another embodiment, the network 150 includes Bluetooth communication networks or a cellular communications network for sending and receiving data such as via short messaging service (SMS), multimedia messaging service (MMS), hypertext transfer protocol (HTTP), direct data connection, wireless application protocol (WAP), email or other types of data known in the art.

Figure 2:
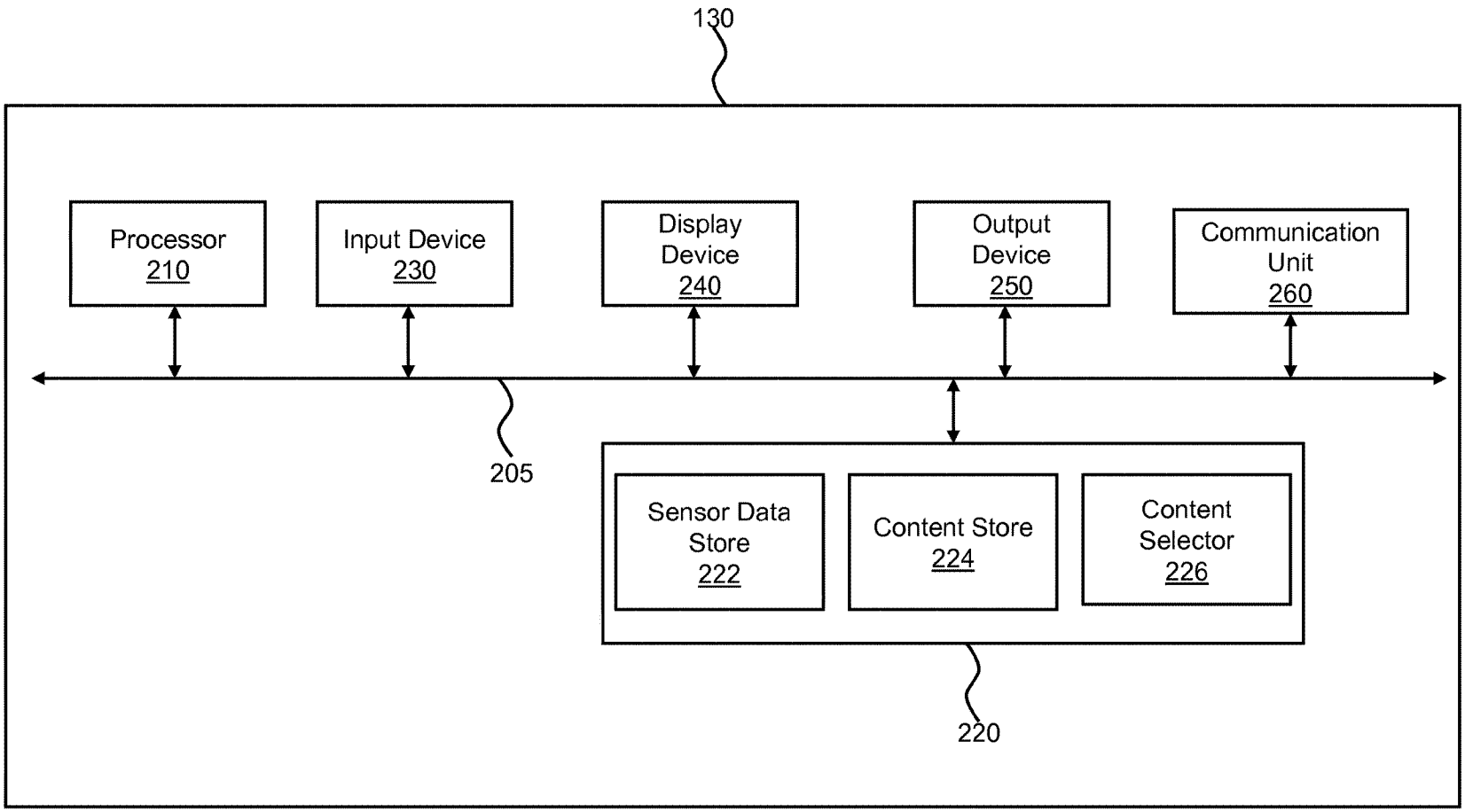
FIG. 2 is a block diagram of a content distribution server in accordance with some embodiments.

FIG. 2 is a block diagram of one embodiment of a content distribution server 130. In the embodiment shown by FIG. 2, the content distribution server 130 includes a processor 210, a storage device 220, an input device 230, a display device 240, an output device 250 and a communication unit 260. The components of the content distribution server 130 are coupled together via a bus 205. However, in different embodiments, the content distribution server 130 may include different and/or additional components than those illustrated by FIG. 2.

The processor 210 processes data or instructions and may comprise various computing architectures. For example, the processor 210 processes data or instructions using a complex instruction set computer (CISC) architecture, a reduced instruction set computer (RISC) architecture, an architecture implementing a combination of instruction sets or any other suitable instruction set. Although FIG. 2 shows a single processor 210, in other embodiments, the content distribution server 130 may include multiple processors. The processor 210 transmits, processes and/or retrieves data from the storage device 220, the input device 230, the display device 240, the output device 250 and the communication unit 260.

The storage device 220 stores data and/or instructions that, when executed by the processor 210, cause the processor 210 to perform one or more actions or to provide one or more types of functionality. The data and/or instructions included in the storage device 220 may comprise computer-readable code that, when executed by the processor 210, performs one or more of the methods described herein and/or provides at least a subset of the functionality described herein. The storage device 220 may comprise a dynamic random access memory (DRAM), a static random access memory (SRAM), a hard disk, an optical storage device, a magnetic storage device, a Read Only Memory (ROM), a Programmable Read Only Memory (PROM), an Erasable Programmable Read Only Memory (EPROM), an Electrically Erasable Programmable Read Only Memory (EEPROM), a Flash memory or another memory device known in the art. The storage device 220 may be a persistent storage device, a non-persistent storage device or a combination of a persistent storage device and a non-persistent storage device, in various embodiments. The storage device 220 is coupled to the processor 210, the input device 230, the display device 240, the output device 250 and/or the communication unit 260 via the bus 205.

In the embodiment shown by FIG. 2, the storage device 220 includes a sensor data store 222, a content store 224 and a content selector 226. In other embodiments, the storage device 220 may include different and/or additional components than those shown in FIG. 2. The sensor data store 222 includes data received from the sensor network 120. In one embodiment, the sensor data store 222 associates data from the sensor network 120 with an account identifier and/or a location identifier. For example, the sensor data store 222 is a database associating an account identifier or a location identifier with data received from the sensor network 120. Examples of data included in the sensor data store 222 include data describing the frequency with which an item at the location is used, data describing power consumption by an item at the location, data describing power efficiency of an item, data identifying one or more attributes of the item or other data describing usage or properties of items at the location. In one embodiment, the sensor data store 222 includes additional information associated with an account or a location associated with the sensor network 120. For example, the sensor data store 222 includes a description of the location associated with the sensor network 120, a type associated with one or more items at the location associated with the sensor network 120, aesthetic information or preferences associated with the location associated with the sensor network 120, items previously acquired for the location associated with the sensor network 120 or any other suitable data.

In one embodiment, the sensor data store 222 includes one or more sensor data privacy settings associated with the account identifier or location identifier. The one or more sensor data privacy settings regulate transmission of stored sensor network data from the content distribution server 130. For example, a sensor data privacy setting may be enabled to prevent transmission of data received from a subset of sensors from the sensor network 120 and to allow transmission of data received from a second subset of sensors from the sensor network 120. As another example, a sensor data privacy setting allows transmission of data received from sensors associated with a first region of the location while preventing transmission of data received from sensors associated with a second region of the location. In some embodiments, additional examples of sensor data privacy settings allow transmission of data received from certain types of sensors and prevent transmission of data received from different types of sensors. Thus, inclusion of sensor data privacy settings in the sensor data store 222 allows customization of the sensor network data capable of transmission from the content distribution server 130 to one or more additional components.

In one embodiment, the sensor data store 222 also includes data received from a client device 110 describing interactions with content using the client device 110. In one embodiment, the client device 110 transmits a content identifier and an interaction identifier to the content distribution server 130 to identify the type of interaction received and the content associated with the interaction. For example, the sensor data store 222 includes a content identifier and an interaction identifier to store date describing prior interactions with content. As an additional example, the sensor data store 222 includes a content identifier specifying a video accessed by a client device 110 and an interaction identifier to describe that the video was played using the client device 110. This allows the sensor data store 222 to supplement data from the sensor network 120 with data describing interactions with previously transmitted content.

The content store 224 is content received from one or more servers 140A, 140N. In one embodiment, the content store 224 includes text, video, audio and/or image data received from one or more servers 140A, 140N. For example, the content store 224 stores advertisements, item reviews, service reviews, contact information or any other type of data for presentation to a user. In one embodiment, the content store 224 includes metadata associated with the stored content and describing attributes or characteristics of the stored content. For example, the content store 224 includes metadata identifying keywords associated with an advertisement or describing the subject matter of the advertisement. Content is retrieved from the content store 224 and transmitted to a client device 110 for presentation to a user. In one embodiment, the content included in the content store 224 is periodically modified. For example, the content store 224 receives new content from one or more servers 140A, 140N at a predetermined interval or a server 140 pushes content to the content store 224 as the server 140 modifies or creates content.

The content selector 226 is data that, when executed by the processor 210, selects a subset of content from the content store 224 for transmission to a client device 110. The content selector 226 compares metadata associated with stored content to data from the sensor network 120 to select content based on the usage of items at the location associated with the sensor network 120 and/or attributes of the location associated with the sensor network 120. In one embodiment, the content selector 226 maps data from the sensor network 120 to selection keywords and compares the selection keywords to metadata associated with stored content. For example, the content selector 226 maps data from the sensor network 120 indicating activation of a stove and/or opening a refrigerator at a predetermined time of day with a selection keyword of "dining," to facilitate identification of stored content associated with metadata matching, or similar to, "dining." As another example, the content selector 226 maps data describing certain types of items or received from certain types of sensors with categories and selects stored content associated with metadata similar to, or matching, a category.

In one embodiment, the content selector 226 also uses stored data describing prior interactions with content using the client device 110 when selecting content. For example, the content selector 226 compares metadata associated with stored content to metadata associated with content previously interacted with by a client device 110. The content selector 226 then selects the subset of content based on the content previously interacted with via a client device 110 in addition to stored data from the sensor network 120. Accounting for content with which a client device 110 previously interacted in addition to sensor network data further increases the likelihood that the selected subset of content will be of interest to a user associated with the account associated with the sensor network 120. Selection of a subset of content from the content store 224 is further described below on conjunction with FIGS. 3 and 4.

The input device 230 is any device configured to receive input and to communicate the received input to the processor 210, to the storage device 220 or to another component of the content distribution server 130. For example, the input device 230 comprises a cursor controller, a touch-sensitive display or a keyboard. In one embodiment, the input device 230 includes an alphanumeric input device, such as a keyboard, a key pad, representations of such created on a touch-sensitive display or another device adapted to communicate information and/or commands to the processor 210 or to the storage device 220. In another embodiment, the input device 230 comprises a device for communicating positional data as well as data or commands to the processor 210 or to the storage device 220 such as a joystick, a mouse, a trackball, a stylus, a touch-sensitive display, directional keys or another suitable input device known in the art.

The display device 240 is a device that displays electronic images and/or data. For example, the display device 240 comprises an organic light emitting diode display (OLED), a liquid crystal display (LCD) or any other suitable device, such as a monitor. In one embodiment, the display device 240 includes a touch-sensitive transparent panel for receiving data or allowing other interaction with the images and/or data displayed by the display device 240.

The output device 250 comprises one or more devices that convey data or information to a user of the content distribution server 130. For example, the output device 250 includes one or more speakers or headphones for presenting audio data to a user. As another example, the output device 250 includes one or more light emitting diodes (LEDs) or other light sources to provide visual data to a user. As another example, the output device 250 includes one or more devices for providing vibrational, or haptic, feedback to a user. The above are merely examples and the output device 250 may include one or more devices for providing auditory output, tactile output, visual output, any combination of the preceding or any other suitable form of output.

The communication unit 260 transmits data and/or content from the content distribution server 130 to the network 150, a client device 110 and/or to the sensor network 120. The communication unit 260 also receives data from a server 140, via the network 150, one or more client devices 110A, 110B and the sensor network 120. In one embodiment, the communication unit 260 comprises a wireless transceiver that transmits and/or receives data using one or more wireless communication protocols. For example, the communication unit 260 includes one or more wireless transceivers transmitting and/or receiving data using one or more wireless communication protocols, such as IEEE 802.11 a/b/g/n (WiFi), Global System for Mobile (GSM), Code Division Multiple Access (CDMA), Universal Mobile Telecommunications System (UMTS), General Packet Radio Service (GPRS), second-generation (2G), or greater, mobile network, third-generation (3G), or greater, mobile network, fourth-generation (4G), or greater, mobile network, High Speed Download Packet Access (HSDPA), High Speed Uplink Packet Access (HSUPA), Long-Term Evolution (LTE), Worldwide Interoperability for Microwave Access (WiMax), near field communication (NFC), BLUETOOTH® or another wireless communication protocol. In another embodiment, the communication unit 260 is a network adapter or other type of wired communication port for communicating with the network 150 or with other devices using a wired communication protocol, such as Universal Serial Bus (USB), Ethernet or another suitable wired communication protocol. In yet another embodiment, the communication unit 260 comprises a combination of one or more transceivers and a wired network adapter, or similar wired device.

In one embodiment, a client device 110 includes components similar to those described above in conjunction with the content distribution server 130 or a subset of the components described above in conjunction with the content distribution server 130. For example, a client device 110 includes a processor 210, a storage device 220, an input device 230, a display device 240, an output device 250 and c communication unit 260 coupled together via a bus 205.

Methods

Figure 3:
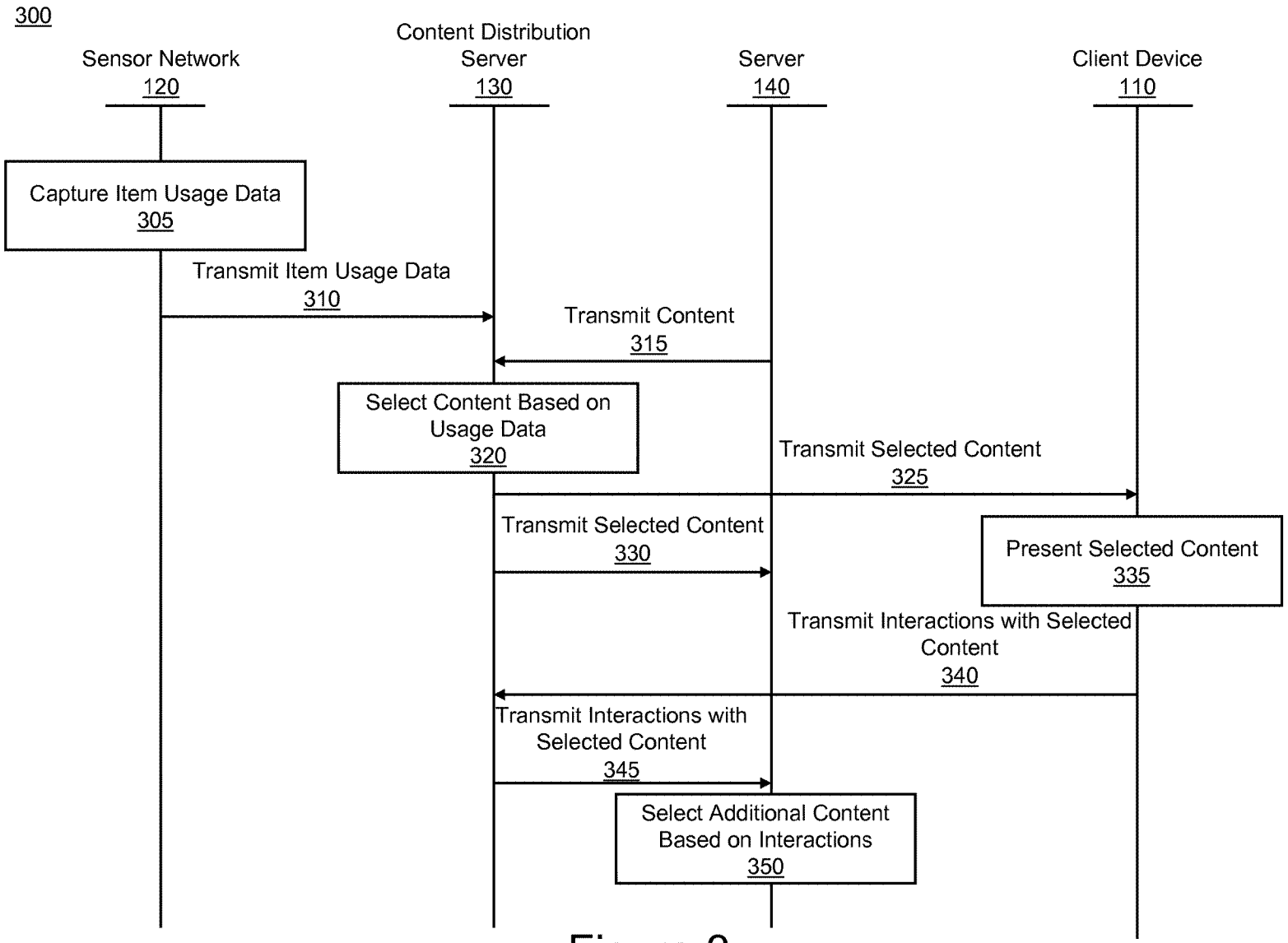
FIG. 3 is an event diagram of a method for selecting content for presentation based on data captured by a sensor network describing item usage in accordance with some embodiments.

FIG. 3 is an event diagram of a method 300 for selecting content for presentation based on data captured by a sensor network 120 describing item usage in accordance with some embodiments. In the example of FIG. 3, the sensor network 120 is associated with a location and with an account. One or more sensors, or a processor, included in the sensor network 120 include data identifying the account, such as an account identifier, and data identifying the location, such as a location identifier.

The sensor network 120 captures 305 data describing use of items at the location associated with the sensor network 120 and/or data describing one or more attributes of the location. For example, the sensor network 120 captures 305 data describing the frequency with which an item is used, power consumption by the item, power efficiency of the item, item health and/or additional sensors capturing or calculating any suitable metric of item usage or resource usage by an item. In one embodiment, the sensor network 120 also captures 305 data describing an item. For example, the sensor network 120 captures 305 data identifying the item from a barcode associated with the item, a radio frequency identification tag attached to the item, a near field communication transceiver associated with the item or any other suitable source of information identifying and/or describing the item. In one embodiment, the sensor network 120 captures 305 data describing the location, such as a temperature, a time or other data describing one or more attributes of the location.

The sensor network 120 transmits 310 the captured data describing item usage and/or location data to the content distribution server 130, which stores the sensor network data in a sensor data store 222. For example, a processor included in the sensor network 120 generates a message including data captured 305 by one or more sensors and the account identifier and/or the location identifier and transmits 310 the message to the content distribution server 130. In one embodiment, the sensor network 120 may transmit 310 additional data to the content distribution server 130. For example, the sensor network 120 transmits 310 a description or attributes of one or more items at the location associated with the sensor network 120 in addition to the data describing usage of and/or resources used by the items. In one embodiment, the sensor network 120 transmits 310 the data using a network 150. Alternatively, the sensor network 120 transmits 310 the data using a direct connection between the sensor network 120 and the content distribution server 130.

A server 140 transmits 315 content to the content distribution server 130 via the network 150, and the content distribution server 130 stores the content in a content store 224. The transmitted content comprises one or more of text, audio, video and/or image data. In one embodiment, the transmitted content includes metadata associated with portions of the content and identifying portions of the content. Examples of metadata include a title, a keyword, a manufacturer identifier, a content creator identifier or any other information describing an attribute of a portion of the content. For example, a server 140 transmits 315 advertisements to the content distribution server 130 along with metadata associating keywords with different advertisements or metadata describing the subject matter or manufacturer associated with the advertisement.

The content distribution server 130 selects 320 a subset of the content based on the stored sensor network data. In one embodiment, a content selector 226 included in the content distribution server 130 compares metadata associated with stored content to data from the sensor network 120 and selects 320 the subset of content based on the usage of items at the location associated with the sensor network 120 and/or attributes of the location associated with the sensor network 120. In one embodiment, the content selector 226 maps data from the sensor network 120 to selection keywords, compares the selection keywords to metadata associated with stored content and selects 320 a subset of the content associated with metadata matching, or similar to, the selection keywords. The content selector 226 may also map metadata associated with the stored content to alternative terms selected from a common source as the selection keywords to facilitate comparison of the metadata to the selection keywords.

In one embodiment, the sensor data store 222 includes data received from a client device 110 describing prior interactions with content by the client device 110. The content selector 226 may select 320 the subset of content using both the prior interactions with content and the data from the sensor network 120. Accounting for content previously interacted with via a client device 110 in addition to sensor network data further increases the likely relevance of the selected subset of content to a user of the client device 110 by accounting for both historical item usage, or item resource usage, and interest in content. Selection of the subset of content is further described below in conjunction with FIG. 4.

The content distribution server 130 transmits 325 the selected subset of content to a client device 110, which presents 335 the selected subset of content to a user. In one embodiment, the selected subset of content is transmitted 325 via the network 150 to the client device 110. Alternatively, a direct connection between the client device 110 and the content distribution server 130 is used to transmit 325 the selected subset of content. In one embodiment, the content distribution server 130 transmits 325 the selected subset of content responsive to receiving a content request from the client device 110, allowing the client device 110 to control when content is transmitted 325 by the content distribution server 130. For example, the client device 110 transmits a content request to the content delivery server 130 at periodic intervals or at predetermined times to receive a new subset of content from the content distribution server 130. As another example, the client device 110 requests content from the content distribution server 130 by transmitting metadata, or other data, to the content distribution server 130; the content distribution server 130 then transmits 325 to the client device 110 content corresponding to the metadata, or other data, received from the client device 110.

Upon receiving the selected subset of content, the client device 110 presents 335 one or more portions of the subset of content using a display device and/or an output device. For example, a display device included in the client device 110 displays video data included in the subset of content and/or displays text or image data included in the subset of content. In one embodiment, the subset of content includes scheduling information used by the client device 110 to determine when portions of the subset of content are presented 335. For example, the scheduling information specifies that portions of the subset of content associated with a keyword, or with certain metadata, are presented at a specific time or are presented when the client device 110 is in a particular region of the location associated with the sensor network 120.

In one embodiment, the content distribution server 130 also transmits 330 the selected subset of content to a server 140, or to one or more servers 140. For example, the content distribution server 130 transmits one or more content identifiers identifying the selected subset of content to the server 140. This provides the server 140 with information about the content transmitted to a client device 110, enabling the refinement of subsequent content transmitted 315 to the content distribution server 130 based on attributes of the selected subset of content. In an alternative embodiment, the content distribution server 130 does not transmit 330 the selected content; for example, responsive to a privacy setting stored in the content distribution server 130, data describing the selected subset of content is not transmitted 330 to the server 140.

Alternatively, the content distribution server 130 transmits the content other than the selected subset of content to the server 140. This provides the server 140 with information about the content that was not transmitted to a client device 110, allowing the server 140 to obtain attributes of content less relevant, or not relevant, to the account associated with the sensor network 120. By identifying the content not selected for the subset of the content, the content distribution server 130 allows the server 140 to increase the relevance content subsequently transmitted 315 to the content distribution server 130 by decreasing the likelihood the server 140 transmits 315 subsequent content having similar attributes to the content not selected for the subset of the content.

In one embodiment, the client device 110 transmits 340 interactions with the selected subset of content by the client device 110, or by a user of the client device 110, to the content distribution server 130. For example, the client device 110 transmits 340 a content identifier and an interaction identifier describing a type of interaction with the subset of the content and the content associated with the interaction. As an additional example, the client device 110 transmits 340 a content identifier specifying video in the subset of content accessed by the client device 110 and an interaction identifier describing that the video was played using the client device 110. Transmitting 340 interactions with the subset of content to the content distribution server 130 allows the sensor data store 222 to supplement data from the sensor network 120 with data describing interactions with content previously transmitted to the client device 110.

In one embodiment, the content distribution server 130 transmits 345 the interactions with the selected subset of content to a server 140 via the network 150. Additional content for transmission to the content distribution server 130 is selected 350 by the server 140 based on the interactions with the selected subset of content. For example, the server 140 selects 350 additional content associated with similar metadata as the content with which the client device 110 previously interacted. However, transmission of the interactions with the selected subset of content to the server 140 is regulated by an interaction privacy setting stored by the sensor data store 222 of the content distribution server 130. In one embodiment, a first value of the interaction privacy setting prevents transmission of interactions with the subset of content to the server 140, a second value of the interaction privacy setting enables transmission of interactions with the subset of content to the server 140 while one or more additional values allow transmission of a subset of the interactions with the subset of content while blocking transmission of a second subset of the interactions with the subset of content.

Figure 4:
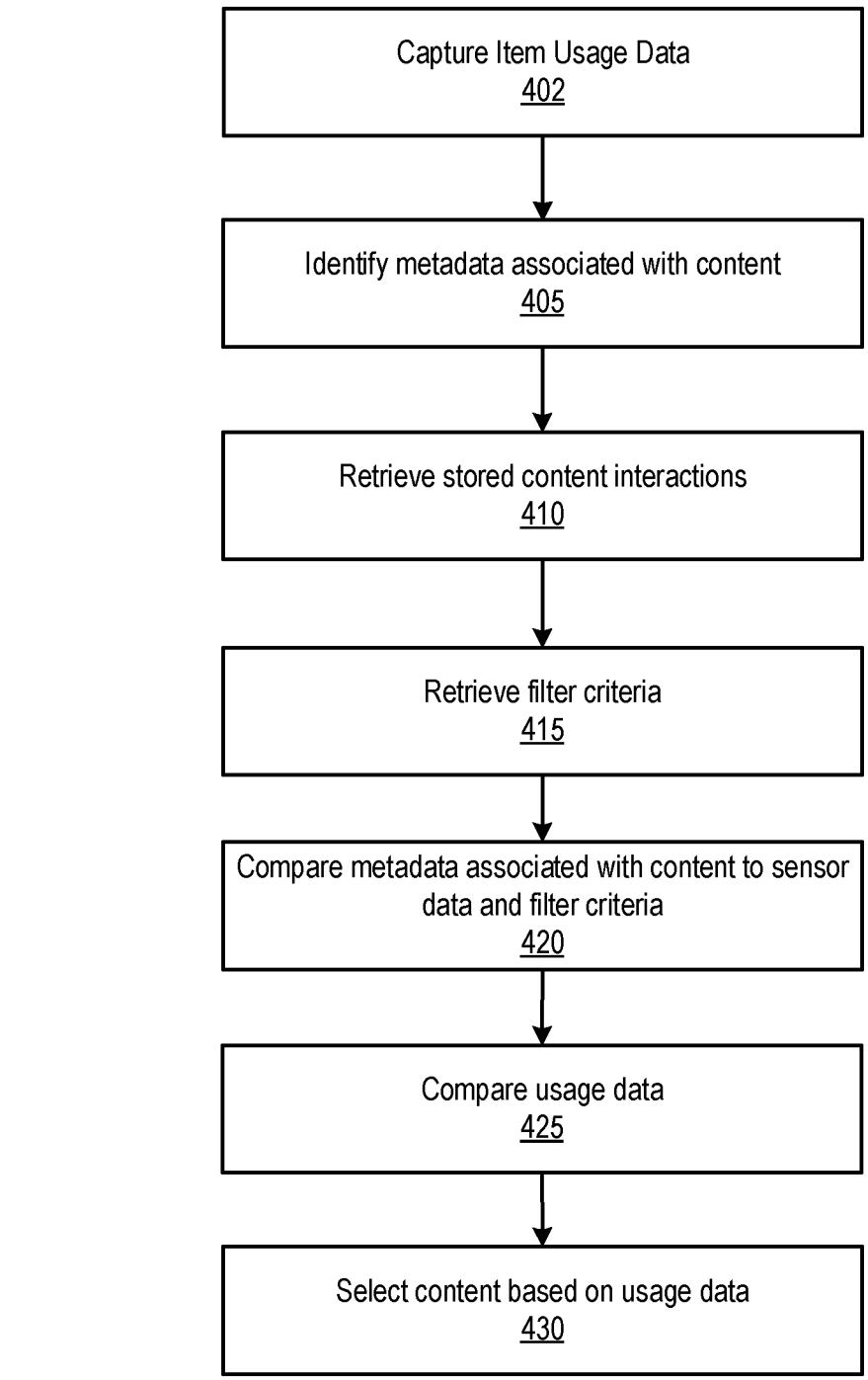
FIG. 4 is a flow chart of a method for selecting content for transmission to a client device based on data from a sensor network and prior interactions with content using the client device in accordance with some embodiments.

FIG. 4 is a flow chart of an embodiment of a method for selecting 320 content for transmission to a client device 110 based on data from a sensor network 120 and prior interactions with content using the client device 110. In one embodiment, the steps illustrated by the method 400 shown by FIG. 4 are implemented by instructions for performing the described actions embodied, or stored, within a non-transitory computer readable storage medium that, when executed by a processor 210, provide the functionality further described below. Examples of a non-transitory computer readable storage medium, such as the storage device 220, include flash memory, random access memory (RAM) or any other suitable medium known to one skilled in the art.

The method 400 may be implemented in embodiments of hardware, software or combinations of hardware and software. In one embodiment, instructions for performing the actions described below are stored in the storage device 220 of the content distribution server 130, such as in the content selector 226, and execution of the instructions by the processor 210 performs the actions described below. Moreover, in some embodiments, the method 400 includes different and/or additional steps than those shown by FIG. 4.

Metadata associated with content included in the content store 224 is identified 405. In one embodiment, data describing interactions with content previously transmitted from the content distribution server 130 to a client device 110 is retrieved 410 from the sensor data store 222. For example, the content selector 226 retrieves 410 a content identifier and an interaction identifier from the sensor data store 222 to identify content and the type of prior interaction with the content. The content selector 226 may retrieve metadata, or additional data, associated with the content from the content store 224 associated with the content previously interacted with by the client device 110.

In one embodiment, the content selector 226 retrieves 415 one or more filter criteria from the storage device 220. For example, the content selector 226 or the content store 224 includes one or more filter criteria associated with the account or the location. In one embodiment, the filter criteria identify metadata, or other data, associated with content in which a user associated with the account has increased interest or has reduced interest. In one embodiment, the filter criteria includes a first set of keywords identifying content in which the user associated with the account has increased interest and/or a second set of keywords identifying content in which the user associated with the account has increased interest. Additionally, the filter criteria may also identify a set of sensor data to exclude from use in content selection. For example, the filter criteria identifies a time interval to exclude data captured by the sensor network 120 during the time interval from use in content selection.

The content selector 226 compares 420 the metadata associated with the content to the data received from the sensor network 120. In one embodiment, the content selector 226 maps data from the sensor network 120 to selection keywords and compares 420 the selection keywords to metadata associated with stored content. For example, the content selector 226 maps data describing certain types of items or from certain types of sensors with categories and selects stored content associated with metadata similar to, or matching, one or more categories. In some embodiments, the content selector 226 may apply the retrieved filter criteria to the sensor network data and/or the metadata associated with the content to modify the selected data based on the filter criteria.

In one embodiment, the metadata associated with the content and the sensor network data is also compared 420 with the retrieved data describing prior interactions with content using the client device 110. For example, the content selector 226 compares 420 metadata associated with stored content to metadata associated with content previously interacted with by a client device 110. The content selector 226 then selects the subset of content based on the content previously interacted with via a client device 110 in addition to stored data from the sensor network data. Accounting for content which was previously interacted with by a client device 110 in addition to sensor network data further increases the likelihood that the selected subset of content will be relevant to a user associated with the account associated with the sensor network 120. In various embodiments, the content selector 226 may differently weight the data from the sensor network 120 and the prior interactions to modify selection of the subset of content.

Hence, the methods 300, 400 described above allows the content distribution server 130 to customize the content transmitted to a client device 110 based on data from a sensor network 120 describing usage of items in a location and/or attributes of the location. For example, the content distribution server 130 selects advertisements for transmission to the client device 110 based on sensor network data describing times when various items are used, the frequency with which different items are used, resources used by various items or similar data. This allows the content distribution server 130 to select advertisements likely to be of interest to a user associated with the sensor network or to select times for transmitting an advertisement to increase the likelihood of the user viewing or accessing the advertisement.

In the foregoing specification, specific embodiments have been described. However, one of ordinary skill in the art appreciates that various modifications and changes can be made without departing from the scope of the invention as set forth in the claims below. Accordingly, the specification and Figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment may be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions, programs, and/or integrated circuits with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A method comprising:

receiving, by a content distribution server and from a sensor network, usage data indicating activation of one or more electronic appliances at a specified time of day and at a location of the sensor network;

identifying, by the content distribution server, content that is available for distribution to a user of the sensor network;

comparing, at the content distribution server, the usage data indicating activation of the one or more electronic appliances at the specified time of day to times when the one or more electronic appliances were previously activated at the location of the sensor network;

filtering out content available to be presented by one or more electronic appliances outside of the times when the one or more electronic appliances were previously activated;

selecting a content item from among the content identified, based on the filtering and the comparison between the usage data indicating activation of the one or more electronic appliances at the specified time and the times when the one or more electronic appliances were previously activated at the location; and transmitting, from the content distribution server, the selected content item for presentation by a client device.

2. The method of claim 1, further comprising:

receiving data describing interaction with the selected content item from the client device; and transmitting the data describing interaction with the one or more of the remaining content items to an appropriate content provider.

3. The method of claim 2, further comprising:

identifying second content from the content providers, the second content determined by the content providers using the data describing interaction with the selected content item.

4. The method of claim 2, wherein transmitting the data describing interaction with the selected content item comprises:

responsive to determining an interaction privacy setting has a first value, transmitting the data describing interaction with the selected content item to the appropriate content provider;

responsive to determining the interaction privacy setting has a second value, not transmitting the data describing interaction with the selected content item to the appropriate content provider; and responsive to determining the interaction privacy setting has a third value, transmitting a first subset of the data describing interaction with the selected content item to the appropriate content provider and not transmitting a second subset of the data describing interaction with the selected content item to the appropriate content provider.

5. The method of claim 1, wherein the usage data includes one or more time intervals indicating times the one or more electronic appliances indicate user interactions, the method further comprising:

transmitting, from the content distribution server, the selected content item for presentation on a client device during the one or more time intervals indicating times the one or more electronic appliances indicate user interactions.

6. The method of claim 1, wherein selecting the one or more of the remaining content items comprises:

identifying metadata associated with the identified content;

retrieving data describing prior interactions with previously identified content;

retrieving second metadata associated with previously identified content associated with a prior interaction; and selecting content associated with metadata that matches one or more keywords that relates to the one or more electronic appliances.

7. The method of claim 1, wherein receiving, from the sensor network, the usage data describing usage of one or more electronic appliances at the location associated with the sensor network comprises:

responsive to a sensor data privacy setting associated with an account associated with the sensor network, receiving a subset of the usage data describing usage of one or more electronic appliances at the location associated with the sensor network, the subset of the usage data defined by the sensor data privacy setting.

8. The method of claim 1, wherein transmitting the selected content item to the client device for presentation comprises:

receiving a content request from the client device; and responsive to receiving the content request, transmitting the selected content item to the client device.

9. The method of claim 1, further comprising:

transmitting data describing content not included in the selected content item to an appropriate server.

10. The method of claim 1, wherein the content comprises advertisements.

11. A system comprising:

a sensor network associated with a location and with an account, the sensor network capturing usage data describing usage of one or more electronic appliances at the location;

a server, having a processor and memory, configured to select and transmit content;

a content distribution server, having a processor and memory, coupled to the sensor network and to the server, the content distribution server configured to:

receive the usage data indicating activation of one or more electronic appliances at a specified time of day and at a location of the sensor network;

identify content from the server that is available for distribution to a user of the sensor network;

compare the usage data indicating activation of the one or more electronic appliances at the specified time of day to times when the one or more electronic appliances were previously activated at the location of the sensor network;

filter out content available to be presented by one or more electronic appliances outside of the times when the one or more electronic appliances were previously activated;

select a content item, from among the content identified, based on the filtering and the comparison between the usage data indicating activation of the one or more electronic appliances at the specified time and the times when the one or more electronic appliances were previously activated at the location; and a client device, having a processor and memory, coupled to the content distribution server, the client device configured to receive the selected content item from the content distribution server and to present the selected content item.

12. The system of claim 11, wherein:

the client device is further configured to transmit data describing one or more interactions with the selected content item to the content distribution server; and the content distribution server is further configured to transmit the data describing one or more interactions with the selected content item to the server.

13. The system of claim 12, wherein:

the server is further configured to determine second content based on one or more attributes of the data describing one or more interactions with the selected content item; and the content distribution server is further configured to receive the second content from the server.

14. The system of claim 11, wherein the usage data includes one or more time intervals indicating times the one or more electronic appliances indicate user interactions, the content distribution server further configured to:

transmit the selected content item for presentation on a client device during the one or more time intervals indicating times the one or more electronic appliances indicate user interactions.

15. The system of claim 11, wherein:

the content distribution server is further configured to determine a time for transmitting the selected content item to the client device based on attributes of the usage data from the sensor network.

16. The system of claim 11, wherein:

the content distribution server is further configured to transmit data describing the selected content item to the server.

17. The system of claim 11, wherein:

the client device is further configured to transmit a content request to the content distribution server; and the content distribution server is configured to responsive to transmit the selected content item responsive to receiving the content request.

18. The system of claim 11, wherein:

the content distribution server is further configured to transmits data describing content not included in the selected content item to the server.

19. The system of claim 11, wherein the content comprises advertisements.

20. A non-transitory computer readable storage medium including instructions that, when executed by a processor, cause the processor to:

receive usage data indicating activation of one or more electronic appliances at a specified time of day and at a location of the sensor network;

identify content that is available for distribution to a user of the sensor network;

compare the usage data indicating activation of the one or more electronic appliances at the specified time of day to times when the one or more electronic appliances were previously activated at the location of the sensor network;

filter out content available to be presented by one or more electronic appliances outside of the times when the one or more electronic appliances were previously activated;

select a content item, from among the content identified, based on the filtering and the comparison between the usage data indicating activation of the one or more electronic appliances at the specified time and the times when the one or more electronic appliances were previously activated at the location; and transmit selected content item for presentation by a client device.

21. The non-transitory computer readable storage medium of claim 20, further comprising instructions, that when executed by the processor, cause the processor to:

receive data, from the client device, describing interaction with the selected content item; and transmit the data describing interaction with the selected content item to an appropriate content provider.

22. The non-transitory computer readable storage medium of claim 21, further comprising instructions, that when executed by the processor, cause the processor to:

receive second content from the content providers, the second content determined by the content providers using the data describing interaction with the selected content item.

23. The non-transitory computer readable storage medium of claim 21, wherein transmit the data describing interaction with the selected content item:

responsive to determining an interaction privacy setting has a first value, transmitting the data describing interaction with the selected content item to the appropriate content provider;

responsive to determining the interaction privacy setting has a second value, not transmitting the data describing interaction with the selected content item to the appropriate content provider; and responsive to determining the interaction privacy setting has a third value, transmitting a first subset of the data describing interaction with the selected content item to the appropriate content provider and not transmitting a second subset of the data describing interaction with the selected content item to the appropriate content provider.

24. The non-transitory computer readable storage medium of claim 20, wherein the usage data includes one or more time intervals indicating times the one or more electronic appliances indicate user interactions, and further comprising instructions, that when executed by the processor, cause the processor to:

transmit the selected content item for presentation on a client device during the one or more time intervals indicating times the one or more electronic appliances indicate user interactions.

* * * * *